US006099160A

United States Patent [19]

Flackett

[11] Patent Number: 6,099,160

[45] Date of Patent: Aug. 8, 2000

[54] MIXING SYSTEM FOR MIXING AND DISPENSING REACTIVE MATERIALS

[75] Inventor: Dale R. Flackett, Landrum, S.C.

[73] Assignee: FlackTek, Inc., S.C.

[21] Appl. No.: 09/274,894

[22] Filed: Mar. 23, 1999

[51] Int. Cl.[7] ..... B01F 9/02

[52] U.S. Cl. ..... 366/217

[58] Field of Search ..... 494/31, 33; 366/130, 366/208–211, 213–217, 219, 255, 256, 267, 139

[56] References Cited

U.S. PATENT DOCUMENTS

| | | | |
|---|---|---|---|
| 1,011,929 | 12/1911 | Ecaubert | 494/33 |
| 3,140,087 | 7/1964 | Krahe et al. | 366/256 |
| 3,390,814 | 7/1968 | Creighton, Jr. et al. | 366/130 |
| 3,730,394 | 5/1973 | Woodson | 366/130 |
| 3,778,033 | 12/1973 | Pullman | 366/219 |
| 4,208,133 | 6/1980 | Korte-Jungermann | 366/130 |
| 4,676,655 | 6/1987 | Handler | 366/130 |
| 4,728,197 | 3/1988 | Reinhard | 366/219 |
| 4,799,801 | 1/1989 | Bruning | 366/256 |
| 4,966,468 | 10/1990 | Bruning | 366/256 |
| 5,167,448 | 12/1992 | Herold et al. | 366/217 |
| 5,328,262 | 7/1994 | Lidgren et al. | 366/139 |
| 5,352,037 | 10/1994 | Jouvin | 366/219 |
| 5,549,380 | 8/1996 | Lidgren et al. | 366/256 |
| 5,551,778 | 9/1996 | Hauke et al. | 366/256 |
| 5,551,779 | 9/1996 | Gantner et al. | 494/33 |
| 5,746,510 | 5/1998 | Mark et al. | 366/217 |
| 5,829,875 | 11/1998 | Hagel et al. | 366/256 |

OTHER PUBLICATIONS

"Einfach gut gemischt . . . "; Hauschild & Co. KG, Date Unknown.

*Primary Examiner*—Charles E. Cooley
*Attorney, Agent, or Firm*—Nilles & Nilles S.C.

[57] ABSTRACT

A mixing system for mixing and dispensing viscous material comprising a mixer, cartridge assembly, and dispenser. This timesaving mixing and dispensing system utilizes a self-contained cartridge assembly that can be transferred directly from the mixer to the dispenser without exposing the reactive materials to the external environment. The cartridge assembly includes a cup having a nipple where a nozzle may be attached for dispensing, a plunger, a cap for the cup, and a removable seal over the opening of the dispensing nipple.

15 Claims, 4 Drawing Sheets

MIXING SYSTEM FOR MIXING AND DISPENSING REACTIVE MATERIALS

BACKGROUND OF THE INVENTION

1. Field of Invention

The invention relates to a mixing system for mixing and dispensing material. More specifically, the invention relates to a mixing system for mixing and dispensing reactive materials comprising a mixer, a dispenser and a transferable cartridge assembly. This mixing system utilizes a unique cartridge assembly that allows viscous, air-curing materials, such as sealants, to be mixed and dispensed while minimizing exposure to the external environment.

2. Discussion of Related Art

Reactive products such as sealants are commonly prepared in a two step process. Raw materials are combined in a mixing machine. After the resulting product is mixed and then de-aired, it is removed from the machine and transferred into dispenser cartridges or pails. The product may be transferred manually by spatula or by extrusion through an opening in the mixing machine. Although manually transferring of the product from the mixer to a dispenser cartridge or pail is more time efficient, the process exposes the resulting product to the external environment by introducing air bubbles into the mixture. This exposure allows the product to react with air, thereby limiting the effectiveness and shelf life of air curing products such as sealant.

Therefore, a need exists for a mixing system that allows small volumes of products to be mixed and quickly dispensed without exposing the product to the external environment.

SUMMARY OF THE INVENTION

The present invention provides a mixing system for mixing and dispensing viscous materials comprising a mixer, a dispenser, and a self-contained cartridge assembly that is easily transferable between the mixer and the dispenser.

The cartridge assembly comprises a cup having a nipple for dispensing material where a nozzle may be attached, a plunger and cap for the cup, and a removable seal over the opening in the dispensing nipple.

In use, reactive products such as sealants and paints, are mixed by adding raw materials inside a cartridge assembly and placing the assembly into the mixing basket of a mixer. After the raw materials are mixed to produce the resulting product, the cartridge assembly is removed from the mixer. The cap is removed and the cartridge is sealed with the plunger and then placed directly into a dispenser or set aside and stored for later use.

If the product is needed immediately, the cartridge assembly is removed from the mixing basket and transferred directly into a dispenser housing. The nipple is cut off and the seal is pierced with a sharp object such as a screwdriver. A nozzle is then attached to the dispensing nipple. The product is dispensed by applying pressure to the plunger to force the product through the opening in the nipple and the attached tip. The plunger within the cup is in direct contact with the material. The material inside the cartridge is never exposed to the external environment.

BRIEF DESCRIPTION OF DRAWINGS

A clear conception of the advantages and features constituting the present invention, and the construction of the operation of typical mechanisms provided with the present invention, will become more readily apparent by referring to the exemplary, and therefore non-limiting, embodiments illustrated in the drawings accompanying and forming part of this specification, wherein like reference numerals designate the elements in several views, and in which.

DETAILED DESCRIPTION OF THE INVENTION

The present invention and various features and advantageous details thereof are explained more fully with reference to the non-limiting embodiments that are illustrated in the accompanying drawings and detailed in the following description. Descriptions of well-known components and processes are omitted so as to not necessarily obscure the present invention in detail.

The present invention is a system for mixing and dispensing reactive material, such as sealant. The system includes a self-contained, dispensing cartridge assembly that allows the material to be mixed and dispensed without being exposed to the external environment.

Figure 1:
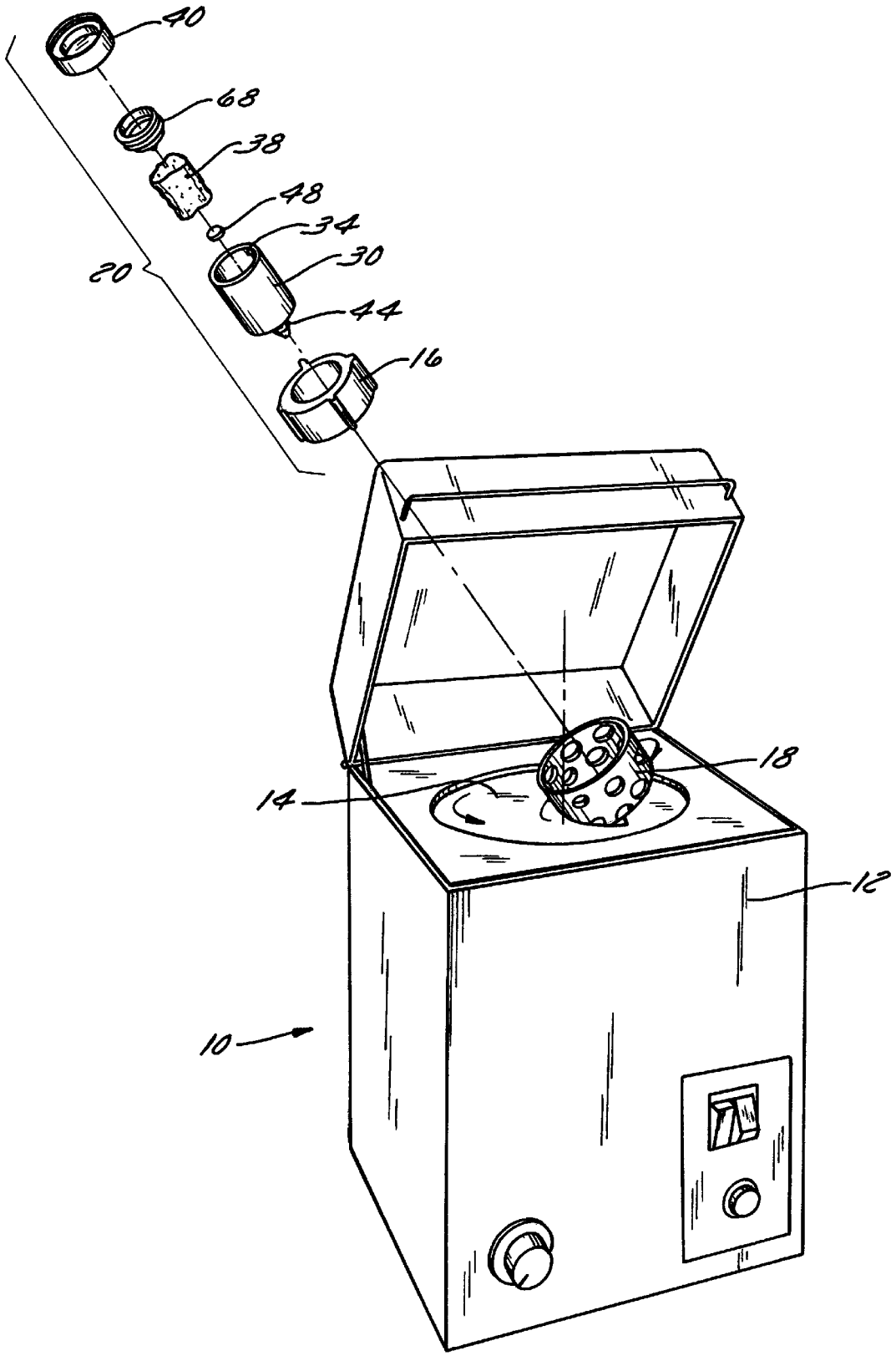
FIG. 1 is an exploded view of a mixer and a cartridge assembly according to the present invention.

Referring now to the drawings, FIG. 1 of the present invention illustrates an exploded view of a mixer 10, and a cartridge assembly 20 of the mixing system.

The illustrated mixer 10 comprises a dual asymmetric centrifuge. It has a housing 12, an arm 14 mounted in operable cooperation with the housing 12, and a basket 18 carried by the arm 14. The basket 18 is shaped and designed to receive the cartridge assembly 20. The arm 14 is constructed and arranged to rotate about a first axis of rotation while the basket 18 is constructed to rotate about a second axis of rotation in a direction opposite the first axis of rotation, when the mixer 10 is in use.

A holder 16, shaped to receive the cartridge assembly 20, may be placed between the cartridge assembly 20 and the basket 18 to stabilize the cartridge assembly 20 during rotation of the basket 18.

The cartridge assembly 20 includes a cup 30 for mixing and dispensing material 38, a seal 48, a plunger 68, and a cap 40. The cup 30 may be formed of a rigid flexible material. The diameter of the cup 30 may range from 2.54–10.16 cm, and most preferably from 4.8–9.0 cm. The length of the cup 30 may range from 2.54–20.0 cm, and most preferably from 3.8–10.16 cm.

Referring now to FIGS. 2–5, the cup 30 has a first opening 34 for receiving materials to be mixed, a mixing chamber 32 having a base 33, and a second opening, 36 for dispensing the mixed material 38. Alternatively, the cup 30 may comprise a generally cylindrical tube having a sidewall that is cut to a length to accommodate a volume of the material 38 to be received in the mixing chamber 32.

The second opening 36 extends from the mixing chamber 32 and through a threaded nipple 44 that extends from the base of the mixing chamber 32. The threaded nipple 44 is designed to receive dispensing nozzle 64. Alternatively, the second opening 36 can be closed by a portion of the nipple 44 that is cut away to expose the second opening 36 such that the second opening 36 extends from the mixing chamber 32 to the exterior of the cup 30.

Figure 3:
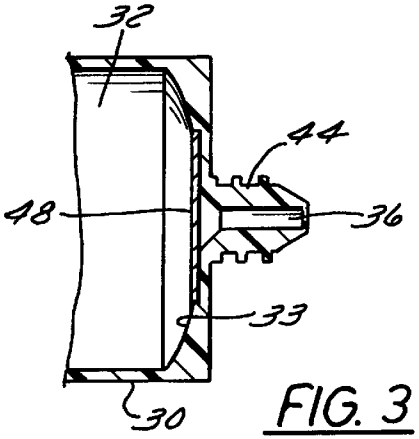
FIG. 3 is a cut away view of the dispensing end of a cartridge assembly showing a seal covering the dispensing orifice according to the present invention.
Figure 2:
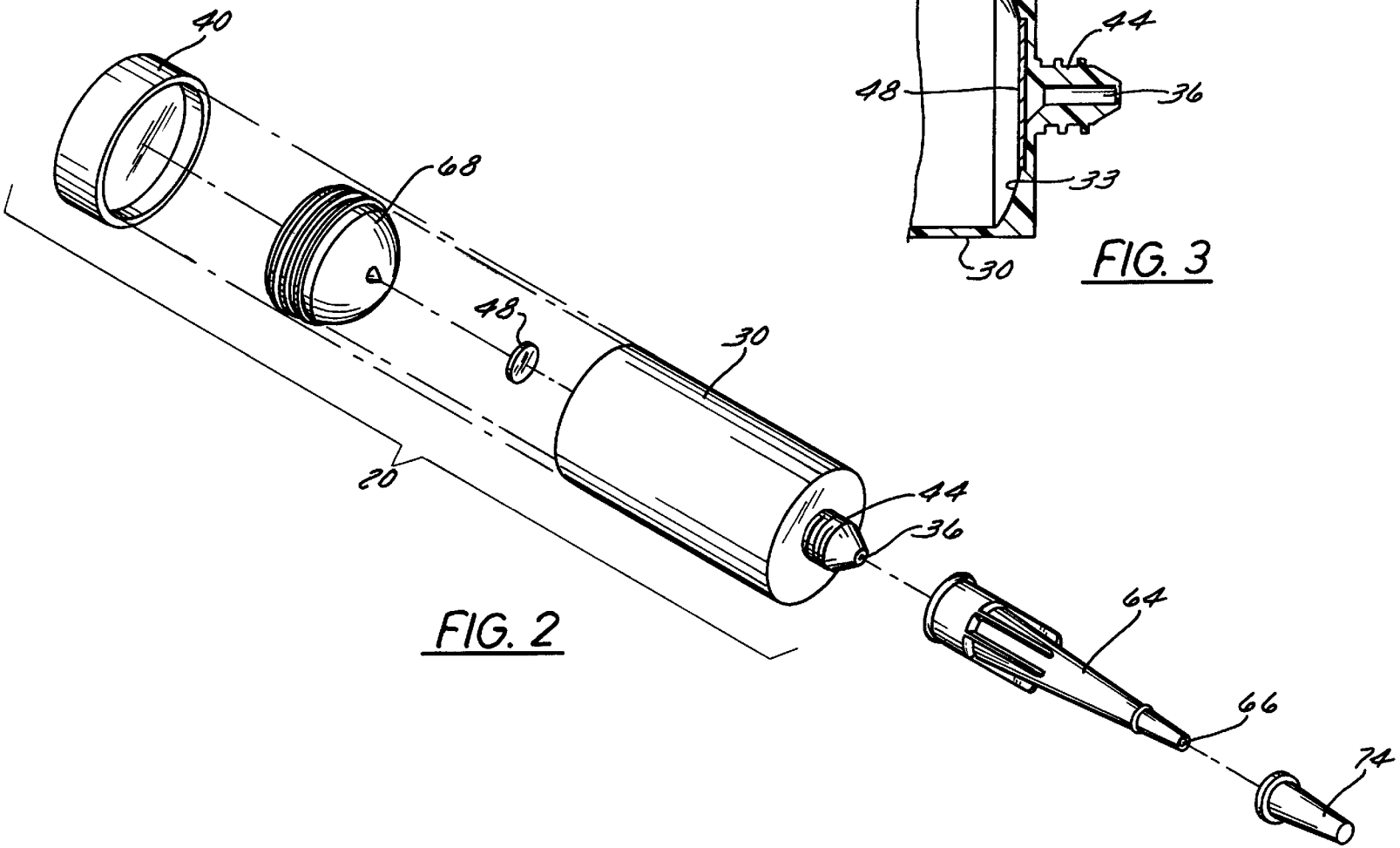
FIG. 2 is an exploded view of a cartridge assembly adapted for dispensing, showing a cap, a plunger, a cartridge, a tip, and a cap for the tip, according to the present invention.

A breakable seal 48 is placed over the second opening 36 to protect material 38 from the external environment and to protect it from leaking out of the cup 30 into the second opening 36 during mixing. The seal 48 may be placed over the second opening 36 in the base 33 of the mixing chamber 32 as depicted in FIG. 3, or alternatively, over the open end of the nipple 44 . The seal 48 may comprise foil or other material that can be ruptured, or alternatively, foil or other material that can be pierced or removed when the seal 48 covers the open end of the nipple 44.

Figure 4:
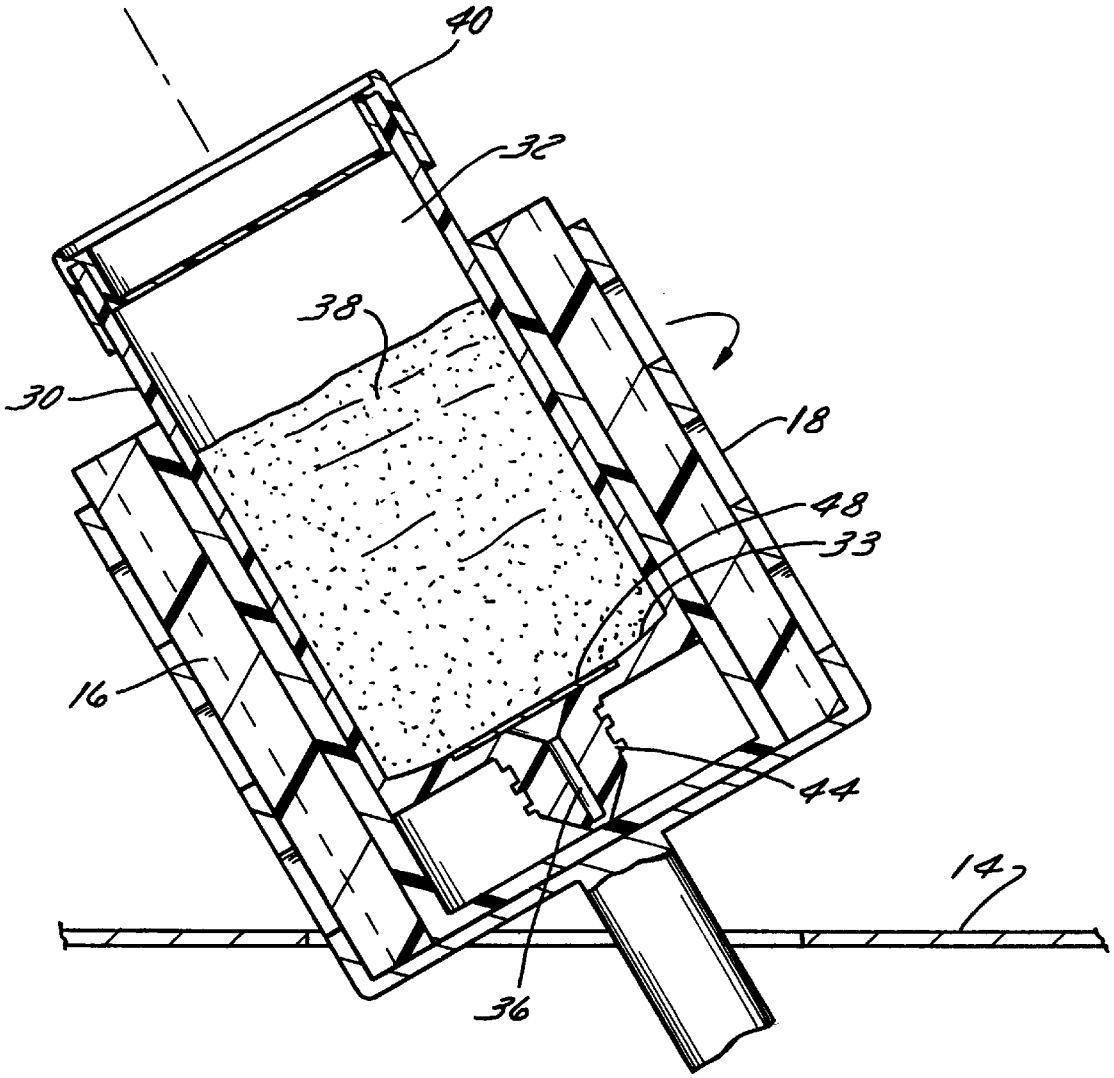
FIG. 4 is a cross sectional view of a filled cartridge assembly received in the mixer basket and covered with a cartridge cap according to the present invention.

The mixing chamber 32 is filled with material 38 and then the removable cap 40 is placed over the first opening 34 to prevent powders and liquids from spraying out during the mixing process. The filled cartridge assembly 20 is then placed into the mixer basket 18 for mixing, as illustrated in FIG. 4. The mixer 10 is then operated to mix the material 38 in the mixing chamber 32. This process may be repeated several times.

Figure 5:
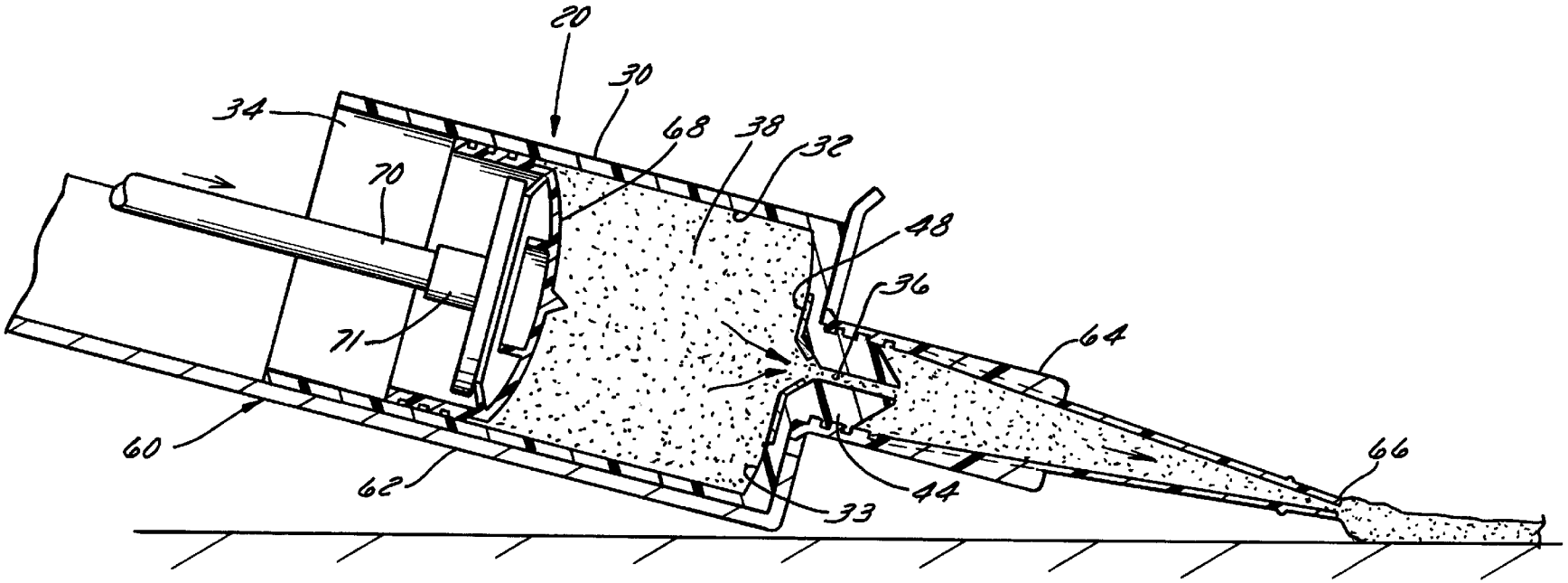
FIG. 5 is a cross sectional view of a filled cartridge mounted within a dispenser, wherein the cap is removed and a plunger is inserted into the cartridge and a tip is attached to the dispensing nipple of the cartridge according to the present invention.

Once mixing is complete, the cartridge assembly 20 is removed from the basket 18. The removable cap is then removed and the plunger 68 is received into the mixing chamber 32 and pressed down until it is flush with material 38 and the air between the plunger and the material is forced out. The full cartridge assembly 20 may then be mounted directly into a dispensing apparatus 60 as illustrated in FIG. 5 or stored for later use.

The dispensing apparatus 60 comprises a frame 62 designed to receive the cartridge assembly 20, a nozzle 64 having an open dispensing tip 66, a nozzle cap 74 for the nozzle 64, and a piston 70 designed to operably cooperate with the plunger 68. In use, the filled cartridge assembly 20 is mounted in the frame 60. The nozzle 64 is threaded onto to the nipple 44. The seal 48 is broken such as by piercing it through the open end of the nipple 44. The piston 70 is inserted into the plunger 68, such as by extending into a tubular end 71 of the plunger 68. Pressure exerted against the plunger 68 forces the material 38 through the second opening 36 and onto an external surface. Where the seal 48 is disposed inside the mixing chamber 32, it must be pierced or otherwise broken so that when the plunger 68 exerts pressure on the material 38, the material can flow out the second opening 36 and be dispensed onto an external surface.

What is claimed is:

1. A mixing system for mixing and dispensing material comprising: a mixer having a housing, an arm rotatably supported by the housing, wherein the arm is constructed and arranged to rotate about a first axis of rotation, and a basket constructed and arranged to rotate about a second axis of rotation in the opposite direction while the arm is rotating:

a cartridge assembly removably received by the basket comprising: a cup having a mixing chamber that receives the material to be mixed, a first opening at one end through which material is introduced into the mixing chamber, and a second opening at another end that extends through a nipple on the exterior surface of the mixing chamber through which the material is urged out of the mixing chamber after mixing is completed; and, a dispenser having a frame constructed and arranged to receive the cartridge assembly after the cartridge assembly is removed from the basket, a plunger that is received in the mixing chamber, and a piston disposed in the mixing chamber that communicates with the plunger to urge the material from the mixing chamber out of a nozzle attached to the nipple.

2. The mixing system of claim 1 wherein the nipple has an opening and further comprising a removable seal over the opening.

3. The mixing system of claim 2 wherein the removable seal comprises a foil that can be pierced or removed to expose the opening.

4. The mixing chamber of claim 3 wherein the foil is disposed inside the mixing chamber.

5. The mixing system of claim 3 wherein the second opening is closed by a portion of the nipple that is cut away to expose the second opening such that the second opening extends from the mixing chamber to the exterior of the cup.

6. The mixing system of claim 1 wherein the plunger substantially air-tightly seals the mixing chamber.

7. The mixing system of claim 1 wherein the cup comprises a generally cylindrical tube having a sidewall that is cut to a length to accommodate the volume of the material during mixing to be received in the mixing chamber.

8. The mixing system of claim 1 further comprising a holder that receives the cup wherein the holder is received in the basket.

9. The mixing system of claim 1 wherein the mixer comprises a dual asymmetric centrifuge.

10. The mixing system of claim 1 wherein a removable cap covers the first opening and prevents material from exiting the mixing chamber during the mixing process.

11. The mixing system of claim 1 wherein the cup is formed of a rigid material.

12. The mixing system of claim 1 wherein the cup is formed of a flexible material.

13. The mixing system of claim 1 wherein the material comprises a sealant when mixed.

14. The mixing system of claim 1, wherein the cup has a diameter between approximately 2.54 and 10.16 cm and a length between approximately 2.54 and 20.0 cm.

15. The mixing system of claim 1, wherein the cup has a diameter between approximately 4.8 and 9.0 cm and a length of approximately 3.8 and 10.16 cm.

* * * * *